US005110028A

United States Patent [19]

Matlock

[11] Patent Number: 5,110,028

[45] Date of Patent: May 5, 1992

[54] SWITCH TIE END PLATING MACHINE

[76] Inventor: Gordon E. Matlock, 554 Sappington Bridge Rd., Sullivan, Mo. 63080

[21] Appl. No.: 647,843

[22] Filed: Jan. 30, 1991

[51] Int. Cl.[5] ..... B25C 7/00

[52] U.S. Cl. ..... 227/39; 227/41; 227/152; 100/232

[58] Field of Search ..... 227/39, 40, 41, 42, 227/100, 152, 153; 100/232

[56] References Cited

U.S. PATENT DOCUMENTS 2,636,525 4/1953 Anguera ..... 227/152
3,207,406 9/1965 Bowman ..... 227/152
3,419,205 12/1968 Jureit et al. ..... 227/152
4,351,465 9/1982 Moehlenpah et al. ..... 227/153
4,373,652 2/1983 Matlock et al. ..... 227/152
4,494,685 1/1985 Matlock ..... 227/41
4,513,900 4/1985 Matlock ..... 227/42

*Primary Examiner*—Douglas D. Watts
*Assistant Examiner*—Scott A. Smith
*Attorney, Agent, or Firm*—Zarley McKee Thomte Voorhees & Sease

[57] ABSTRACT

An end plating machine capable of forcing end plates into the ends of a pair of ties having various lengths. The machine includes spaced apart tie staging chambers and an end plating ram which may be selectively positioned between tie ends of the ties in the staging chambers to force tie end plates into the ties.

6 Claims, 10 Drawing Sheets

SWITCH TIE END PLATING MACHINE

BACKGROUND OF THE INVENTION

This invention relates to a switch tie end plating machine and more particularly to a switch tie end plating machine which has the ability to end plate switch ties of different lengths.

Switch ties for use in the railroad industry are normally formed from green wood and frequently develop splits in the ends thereof during the seasoning process. It has been found desirable to close the splits or cracks in the ends of the tie and to maintain the same in that condition by means of nail plates, dowels, S-irons, etc. Many prior art devices have been provided for squeezing the ends of the tie together and then driving a nail plate or end plate into the end thereof, but the prior art machines are extremely expensive and consume large amounts of energy.

In an effort to overcome the shortcomings of the prior art, applicant has previously patented end plating machines for cross ties. For example, see U.S. Pat. Nos. 4,494,685 and 4,513,900. The plating machines in my previous patents were designed for cross ties which normally have a standard length. Although the machines disclosed in my prior patents do disclose an improved means for end plating cross ties, those machines were not capable of end plating switch ties which may have lengths of from nine feet to 24 feet. Further, if a machine is designed to handle nine-foot switch ties, that machine would not be able to handle switch ties having greater lengths. Further, the switch ties of a particular length may not always be cut to the proper exact length and it is therefore desirable to be able to provide an end plating machine which is capable of handling switch ties having various lengths.

It is therefore a principal object of the invention to provide an improve switch tie end plating machine.

A further object of the invention is to provide a switch tie end plating machine which has the ability to handle switch ties having various lengths.

Still another object of the invention is to provide a switch tie end plating machine having a plurality of variable position limiting gates positioned in staging chambers disposed on opposite sides of the end plating mechanism.

Still another object of the invention is to provide a switch tie end plating machine having the ability to end plate the ends of a pair of switch ties at the same time.

Still another object of the invention is to provide a switch tie end plating machine which is economical of manufacture and durable in use.

These and other objects of the present invention will be apparent to those skilled in the art.

SUMMARY OF THE INVENTION

A switch tie end plating machine is described which is capable of handling switch ties having various lengths. The apparatus of this invention comprises a first staging chamber having an input end and a discharge end with a first conveyor means positioned therein for conveying a switch tie therethrough from the input end to the discharge end. A second staging chamber is aligned with the first staging chamber but is spaced therefrom and also has an input end and a discharge end. A second conveyor is positioned in the second staging chamber and is designed to convey a switch tie therethrough from the input end to the discharge end. An end plating mechanism is positioned between the discharge end of the first staging chamber and the input end of the second staging chamber and includes a pair of oppositely extending rams which drive end plates into one end of a switch tie positioned in the first staging chamber and one end of a switch tie positioned in the second staging chamber. The ram means may be pivoted from an operative position to an inoperative position to enable the switch tie from the first staging chamber to be conveyed to the second staging chamber. Each of the staging chambers is provided with variable position limiting gates or stop means which are lowered into position in the movable path of the switch ties to resist longitudinal movement of the switch ties as the rams are driving the end plates into the ends thereof. The variable position limiting gates permit the apparatus to compensate for switch ties having various lengths. The apparatus also includes means for squeezing the ends of the ties together prior to the end plates being driven into the ends thereof.

DESCRIPTION OF THE PREFERRED EMBODIMENT

Figures 1, 2:
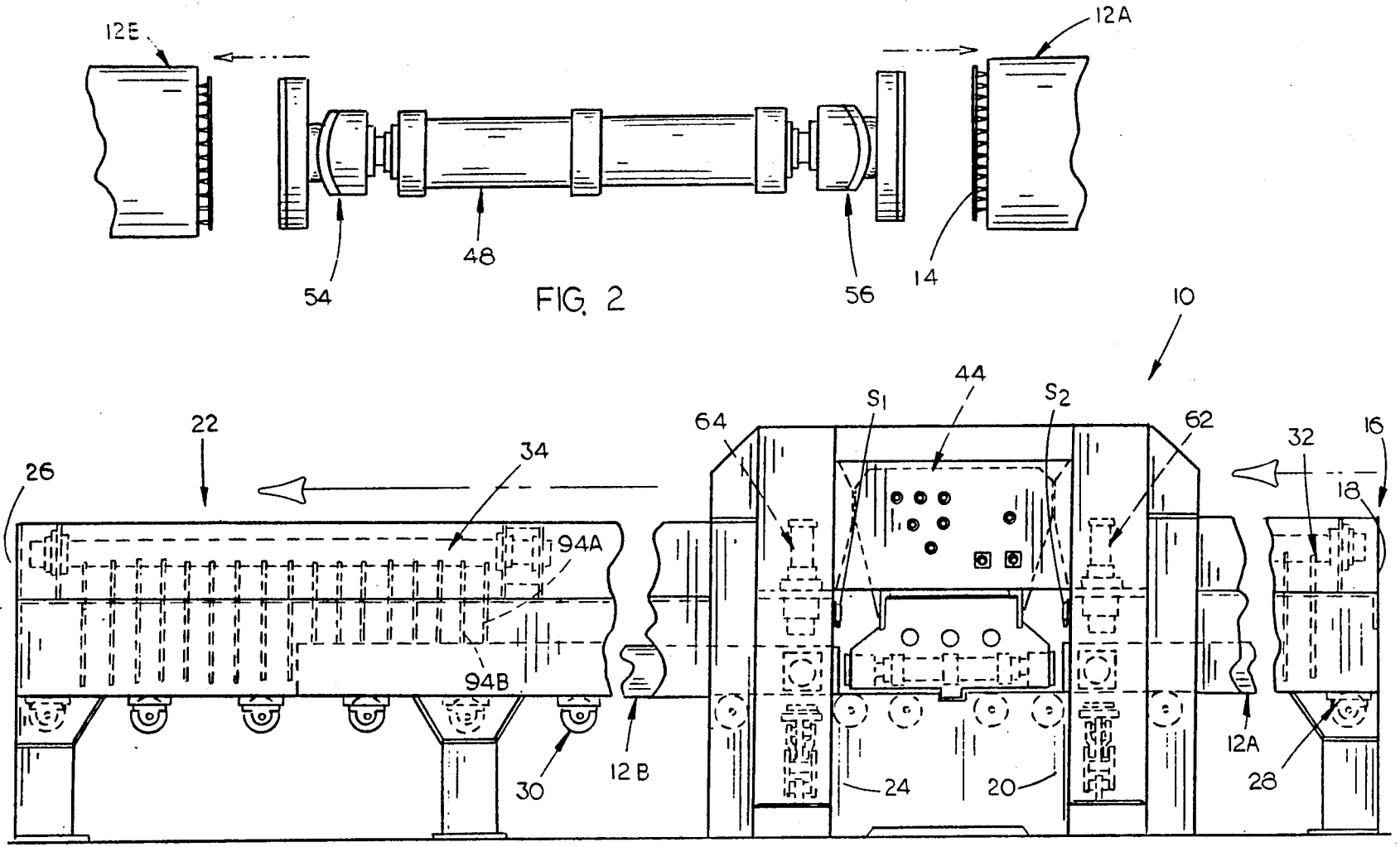
FIG. 1 is a partial side elevational view of the end plating machine of this invention.
FIG. 2 is a top view illustrating the means for driving end plates into the ends of a pair of switch ties.

The switch tie end plating machine of this invention is referred to generally by the reference numeral 10 and is designed to end plate the ends of a pair of switch ties referred to generally by the reference numerals **12*a* and 12*b* respectively. The end plate which is to be driven into the ends of the switch ties is referred to generally by the reference numeral 14**.

End plating machine 10 includes a first staging chamber 16 having an input end 18 and a discharge end 20. The numeral 22 refers to a second staging chamber having an input end 24 and a discharge end 26. A first conveyor means 28 is provided in staging chamber 16 for conveying a switch tie therethrough from the inlet end 18 to the discharge end 20. The inlet end of staging chamber 16 is in communication with a conveyor means or the like for supplying the switch ties thereto. Second staging chamber 22 is also provided with a conveyor means which is referred to by the reference numeral 30 and which is designed to convey a switch tie therethrough from the inlet end thereof to the discharge end thereof. Although the conveyors 28 and 30 may be of any design, it is recommended that the conveyors be comprised of a plurality of horizontally disposed rollers, all of which or some of which may be driven. Staging chamber 16 is provided with a variable position limiting gate means 32 while staging chamber 22 is provided with a variable position limiting gate means 34. Inasmuch as the variable position limiting gate means 32 and 34 are identical, only gate means 34 will be described in detail.

The numeral 36 refers to an end plating mechanism including frame means 38 which is positioned between the discharge end of staging chamber 16 and the input end of staging chamber 22. Plating mechanism 36 includes a conveyor means 40 provided therein which is designed to convey a tie from the discharge end of staging chamber 16 into the inlet end of staging chamber 22. Preferably, conveyor means 40 includes a plurality of powered rollers 42 which are rotatable about a horizontal axis.

Figure 5:
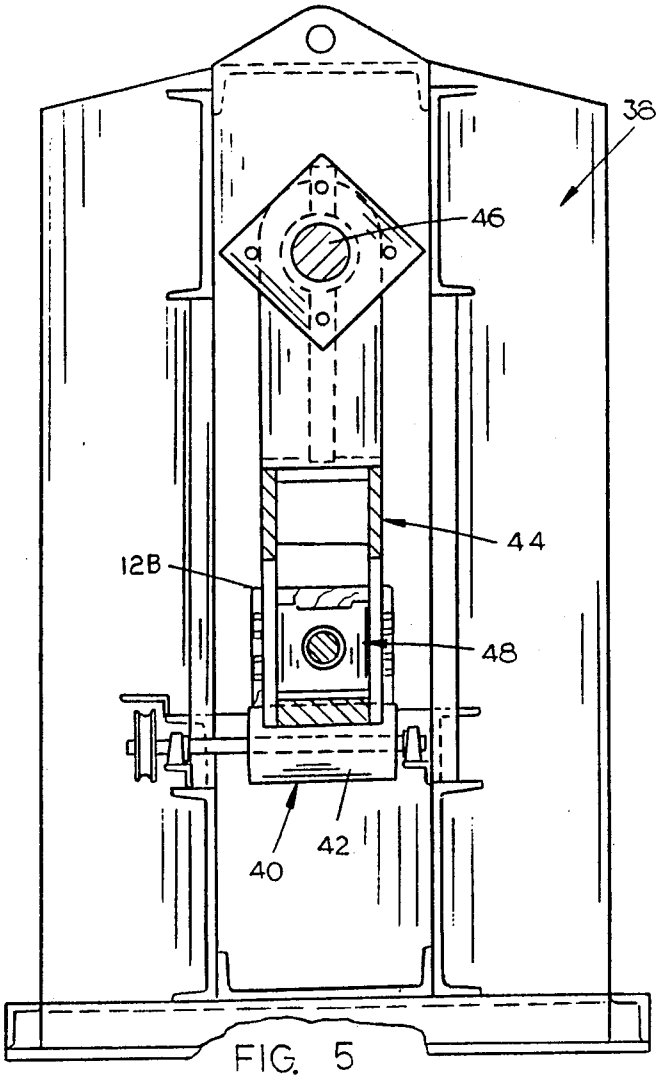
FIG. 5 is a sectional view similar to that of FIG. 4 except that the end plating mechanism has been positioned in its operative position.
Figure 4:
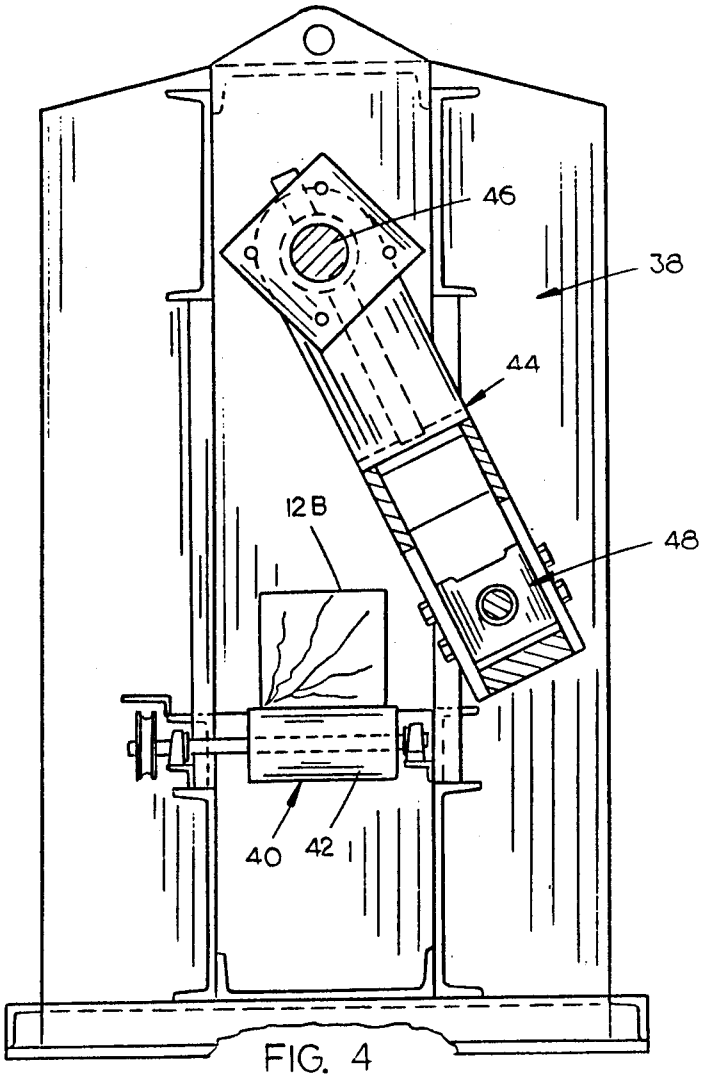
FIG. 4 is a sectional view illustrating the end plating mechanism positioned in its inoperative position.
Figure 3:
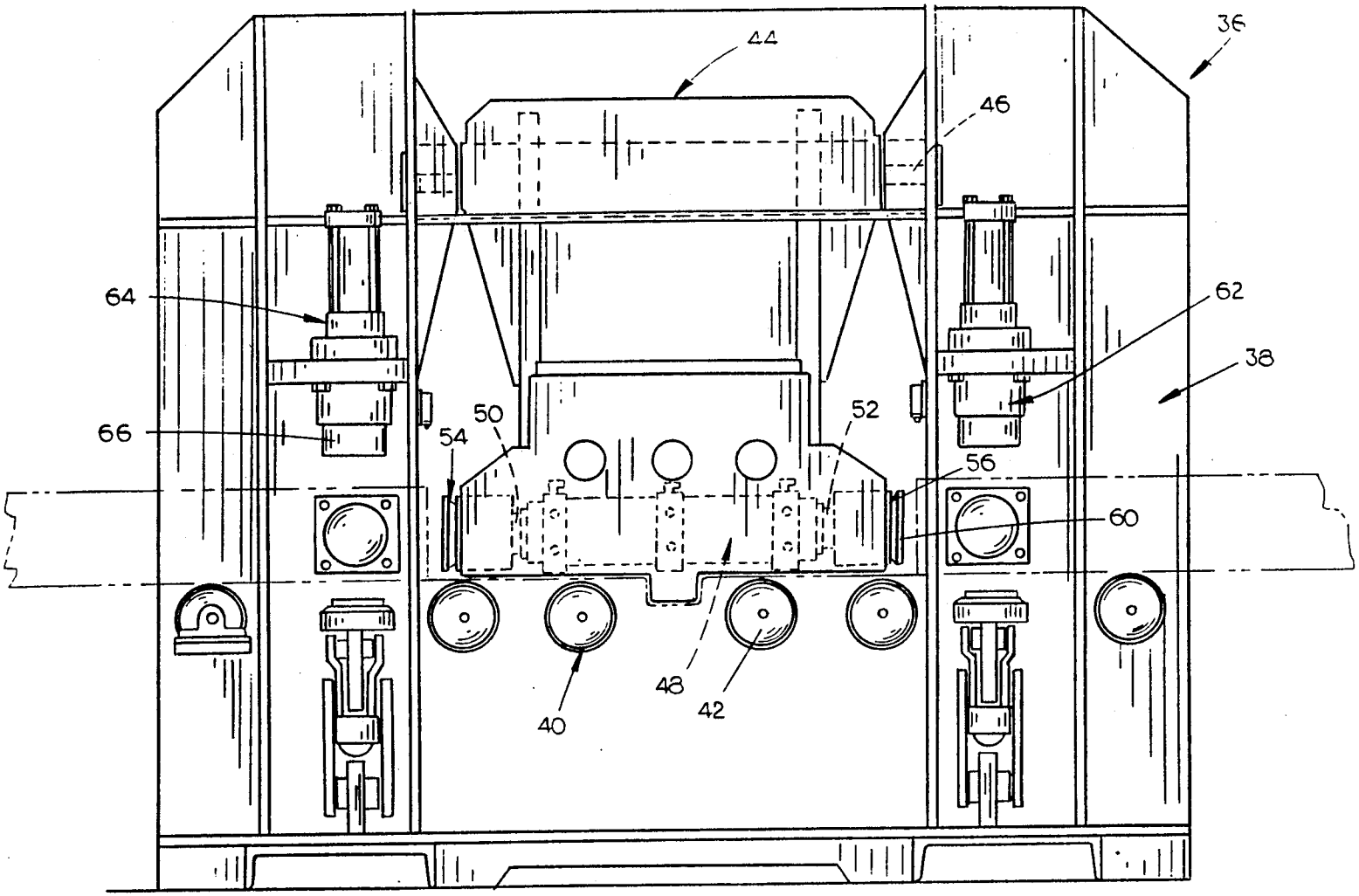
FIG. 3 is a side elevational view of the end plating mechanism.
Figure 6:
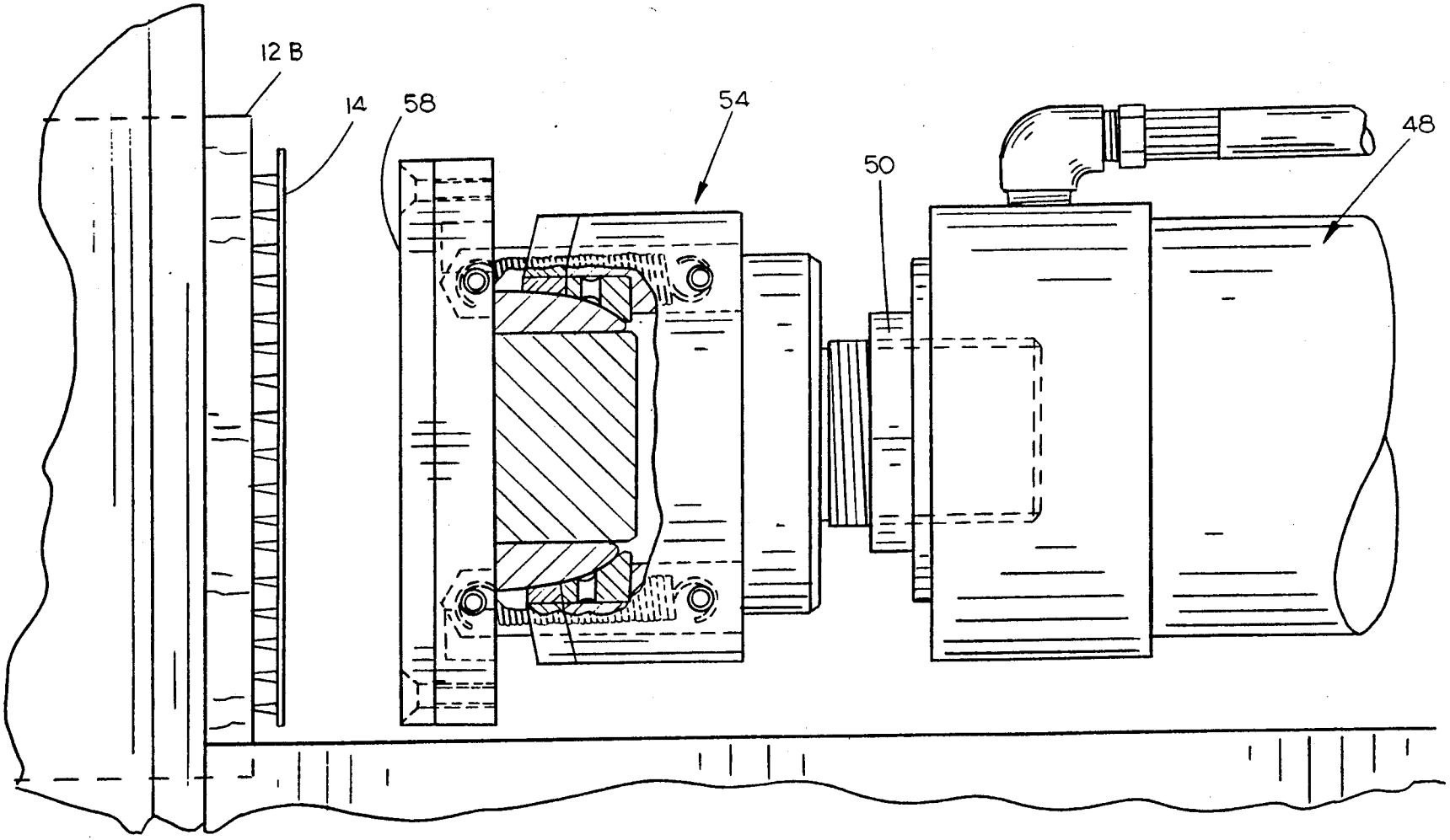
FIG. 6 is a side elevational view of one end of the end plating mechanism with portions thereof cut away to more fully illustrate the invention.

Ram support 44 is pivotally connected about a vertical axis 46 to frame means 38 and is selectively pivotally moved from the inoperative position illustrated in FIG. 4 to the operative position illustrated in FIG. 5. End plating mechanism 36 includes a hydraulic cylinder means 48 having a pair of rams 50 and 52 extending from the opposites ends thereof. A spring-loaded floating or swivel head 54 is mounted on the outer end of ram 50 while a spring-loaded floating or swivel head 56 is mounted on the outer end of ram 52. Heads 54 and 56 include end plate engaging portions 58 and 60 which are designed to engage the end plates and to force the same into the ends of the ties. Heads 54 and 56 are similar to that disclosed in U.S. Pat. No. 4,494,685 to compensate for irregularities in the outer end of the tie.

A tie squeezing or compression means 62 is provided at one end of the end plating mechanism while a tie compression or squeezing means 64 is provided at the other end of the end plating mechanism. Tie squeezing means 62 is designed to squeeze or compress the end of the tie in staging chamber 16 to enable an end plate to be secured thereto while compression means 64 is provided to squeeze the end of the tie positioned in staging chamber 22 to enable the end plate to be applied to the end thereof. Inasmuch as the tie squeezing means 62 and 64 are identical, only tie squeezing means 64 will be described in detail.

Figure 7:
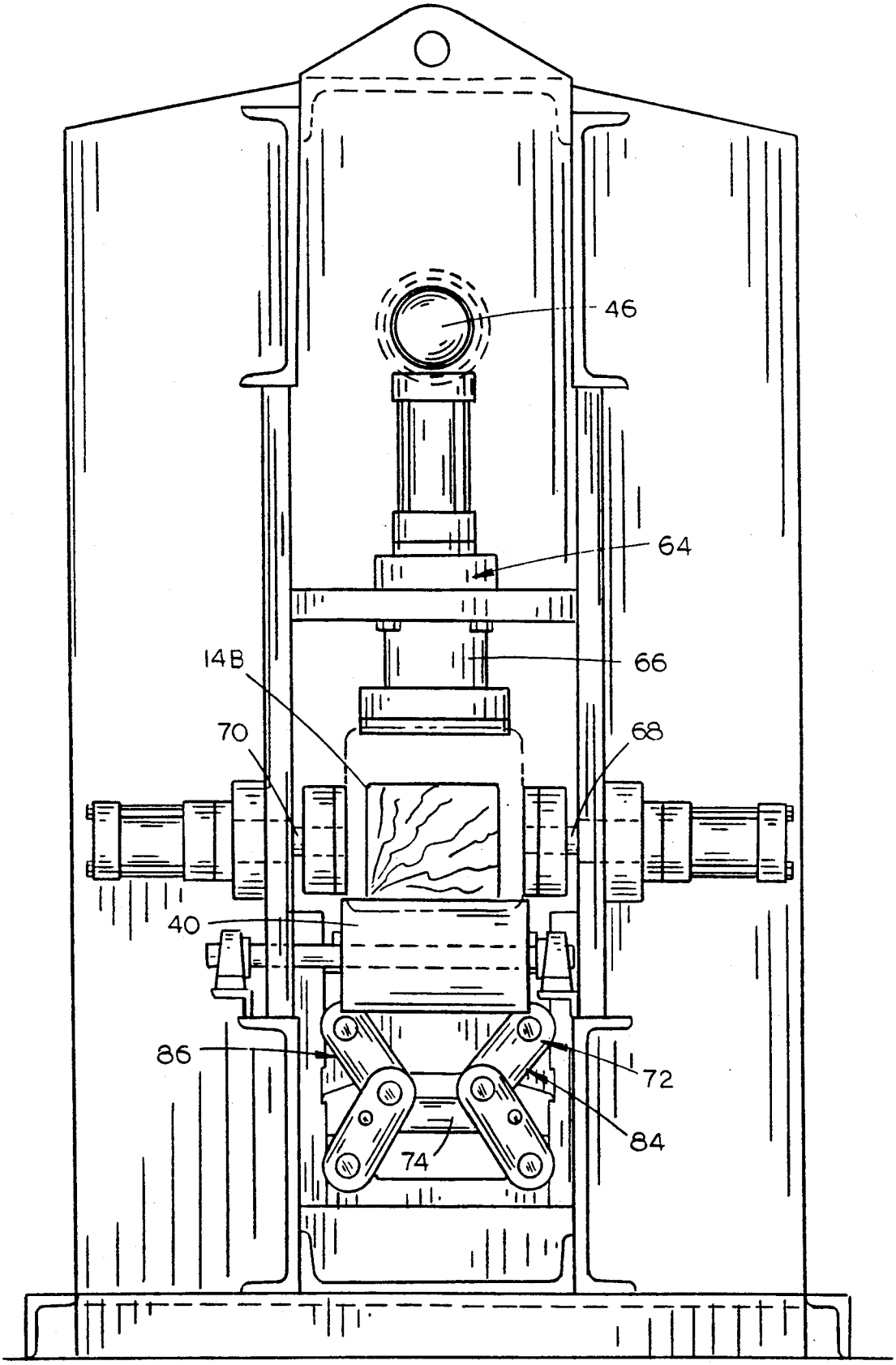
FIG. 7 is a sectional view seen on lines 7—7 of FIG. 3.
Figure 8:
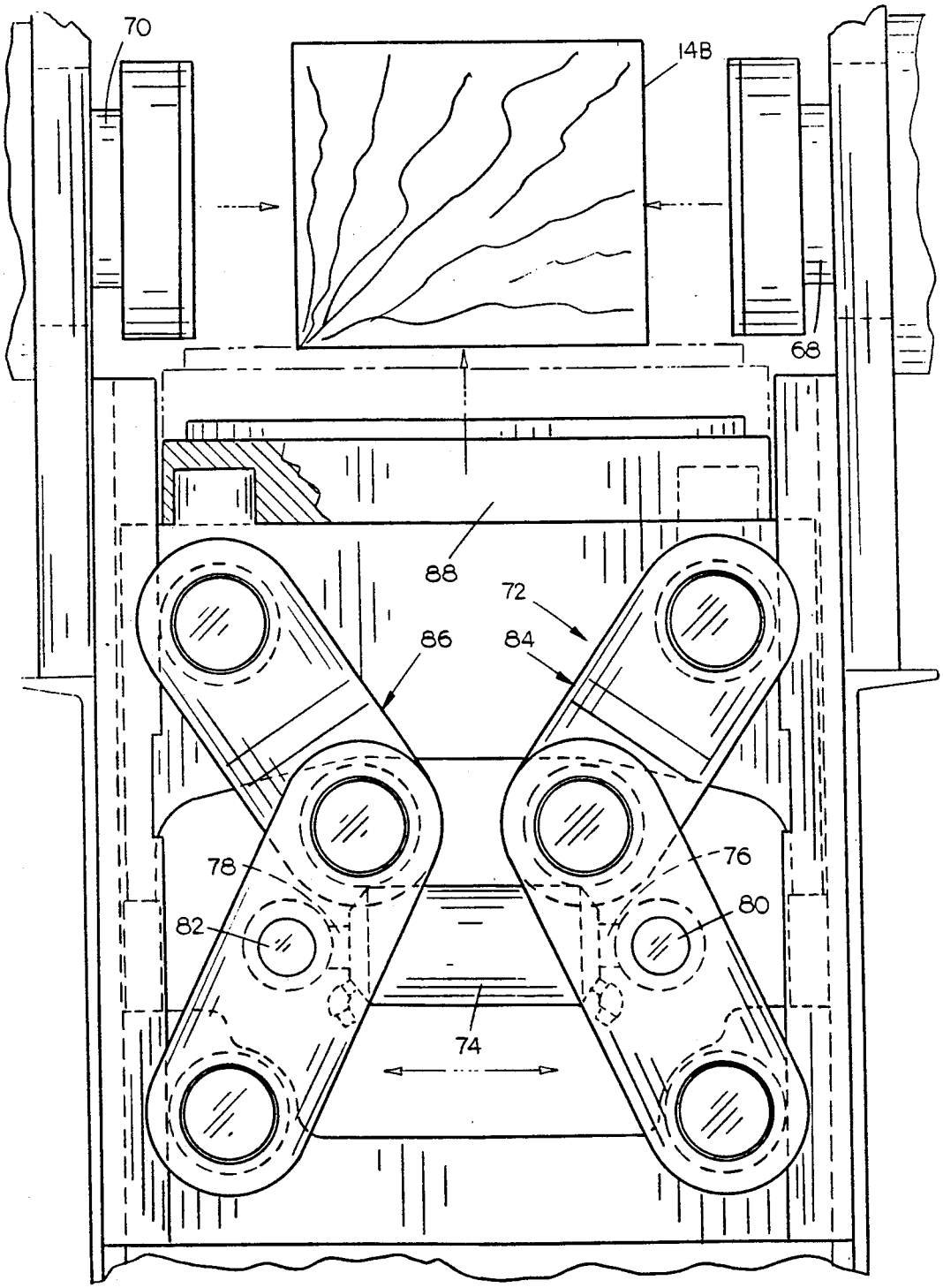
FIG. 8 is a large partial view of FIG. 7 with portions thereof cut away to more fully illustrate the invention.
Figure 9:
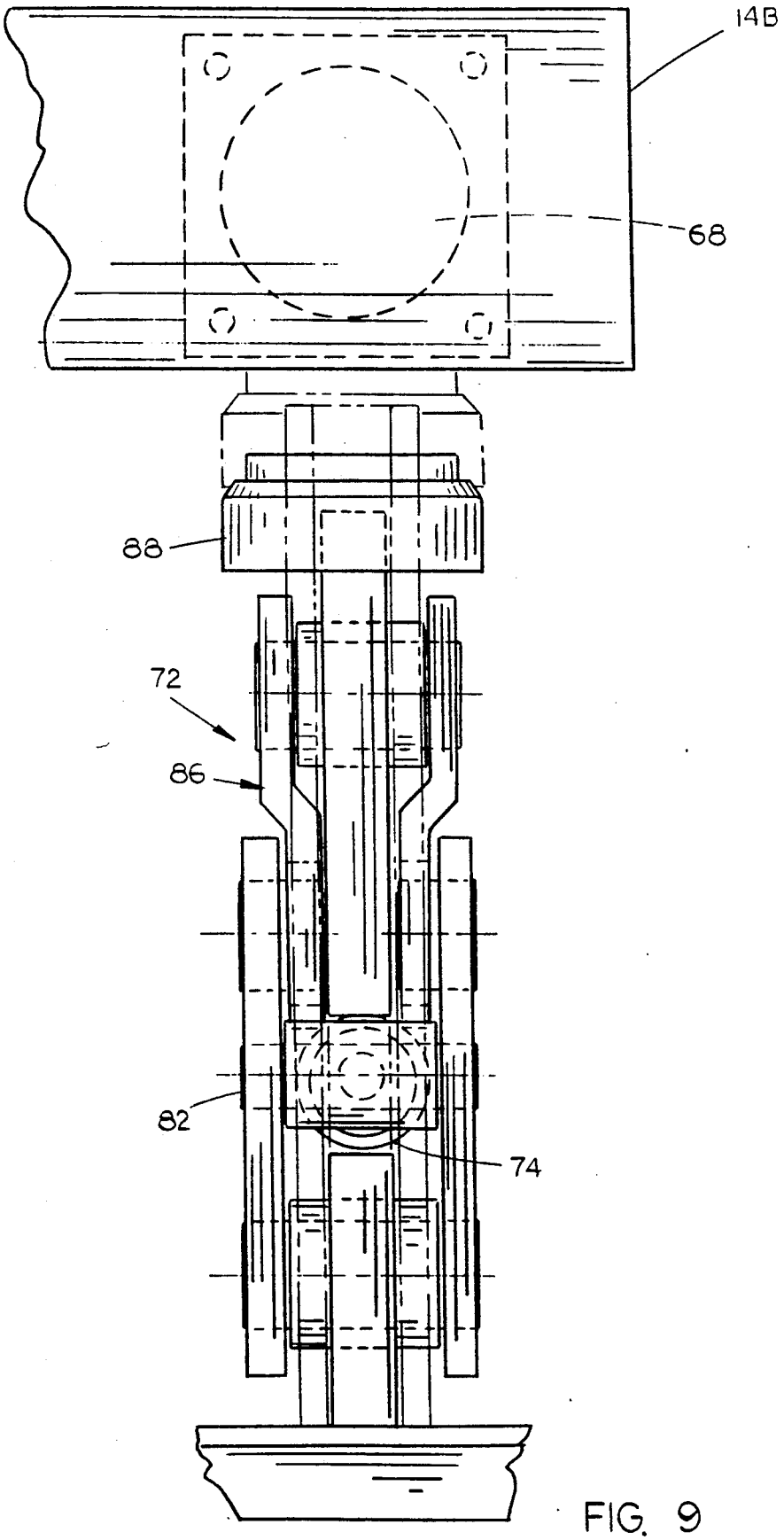
FIG. 9 is a view seen on lines 9—9 of FIG. 7.
Figure 10:
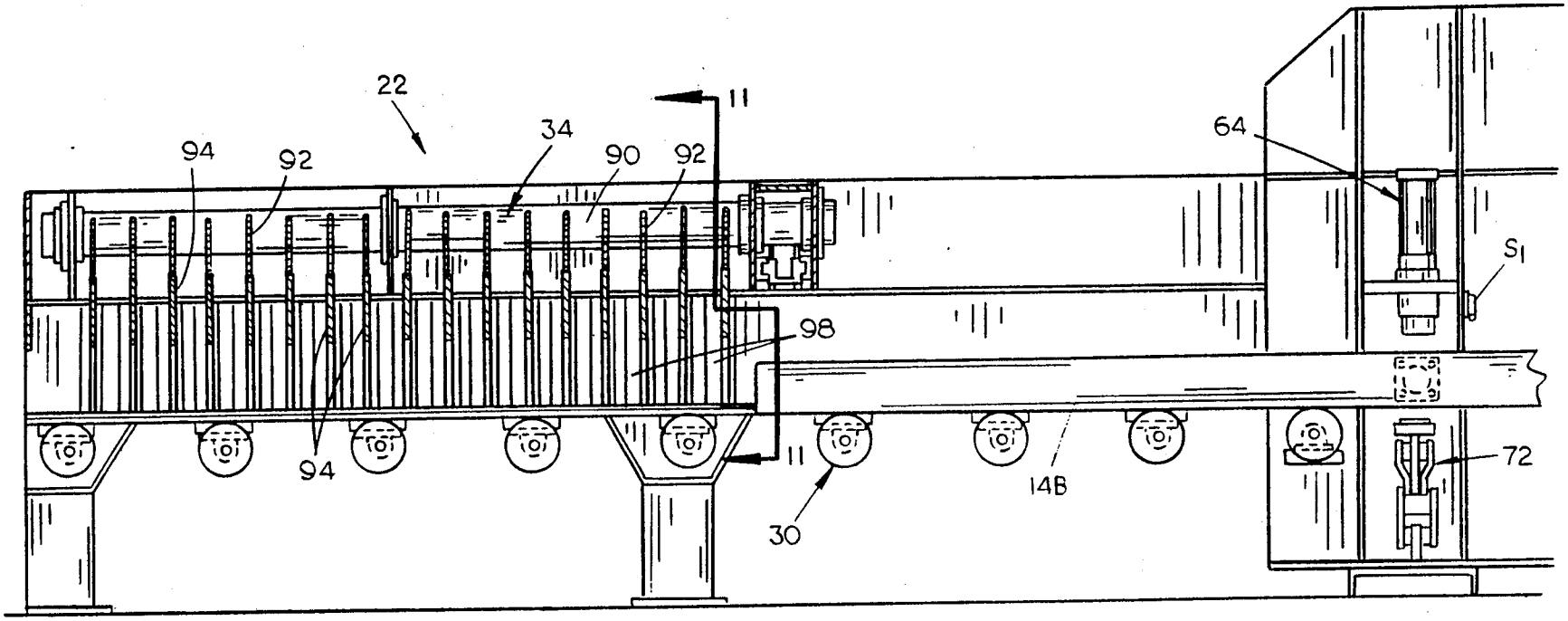
FIG. 10 is a side view of a portion of the second staging chamber with portions thereof cut away to more fully illustrate the invention.

Tie squeezing means 64 includes a first ram means 66 which is adapted to be lowered into engagement with the upper end of the tie positioned in staging chamber 22 to apply vertical compressive force thereto. Rams 68 and 70 are provided for applying horizontal compressive forces to opposite sides of the tie positioned in staging chamber 22 as illustrated in the drawings. FIGS. 7 and 8 illustrate the tie compression means which is provided beneath the end of the tie positioned in staging chamber 22 and which is referred to generally by the reference numeral 72.

Compression means 72 includes a hydraulic cylinder 74 having ram or rods 76 and 78 extending from the opposite ends thereof which are connected to pivots 80 and 82 respectively. Pivot 80 is operative connected to linkage 84 while pivot 82 is operatively connected to linkage 86 as best seen in FIG. 8. The upper ends of linkage means 84 and 86 are connected to platen 88 which is moved upwardly into engagement with the underside of the tie upon the extension of the rods 76 and 78 from the cylinder 74. Thus, with the structure just described, it can be seen that means is provided for compressing the end of the tie positioned in staging chamber 22 to close the splits or cracks therein prior to the end plate being secured thereto. The end of the tie in staging chamber 16 is also similarly compressed or squeezed prior to and during the time that the end plate is being driven or set therein.

To enable the end plating machine of this invention to compensate for switch ties having various lengths, variable position limiting gates are provided in each of the staging chambers. The variable position limiting gate means positioned in staging chamber 16 is referred to generally by reference numeral 32 as previously described, while the variable position limiting gate means in staging chamber 22 is referred to generally by the reference numeral 34 as previously described. Inasmuch as the variable position limiting gate means in each of the staging chambers are identical, only the variable position limiting gate means 34 in staging chamber 22 will be described.

Figure 13:
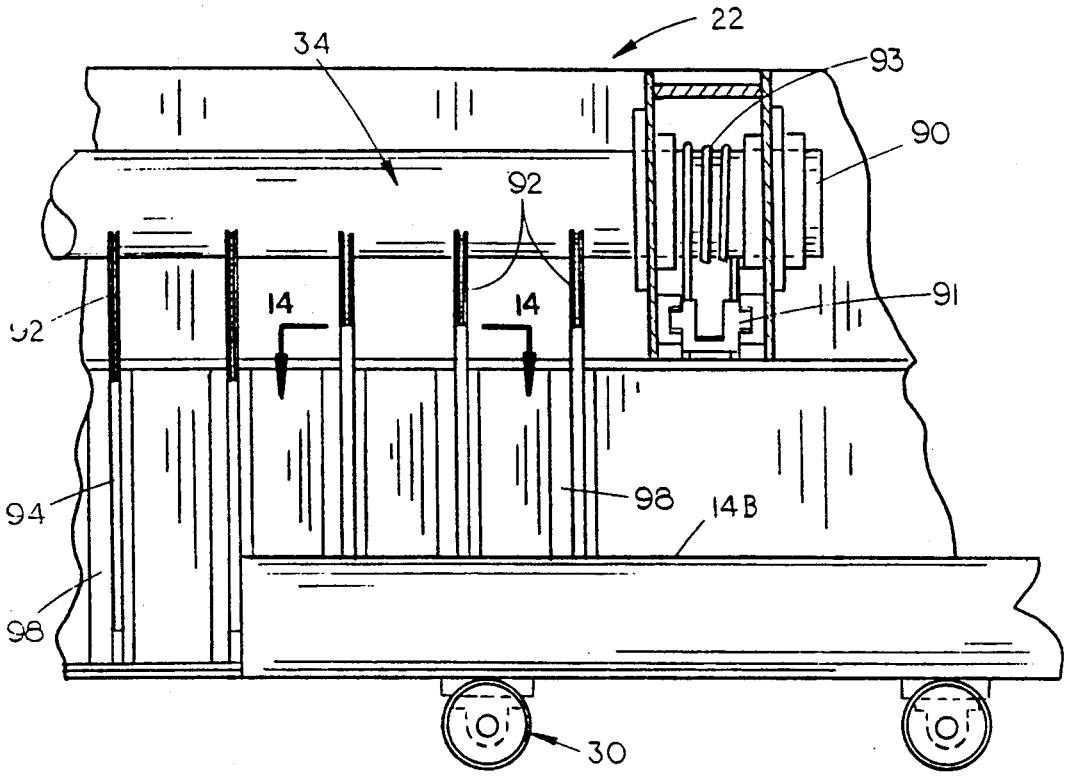
FIG. 13 is a side view of a portion of the second staging chamber with portions thereof cut away.
Figure 14:
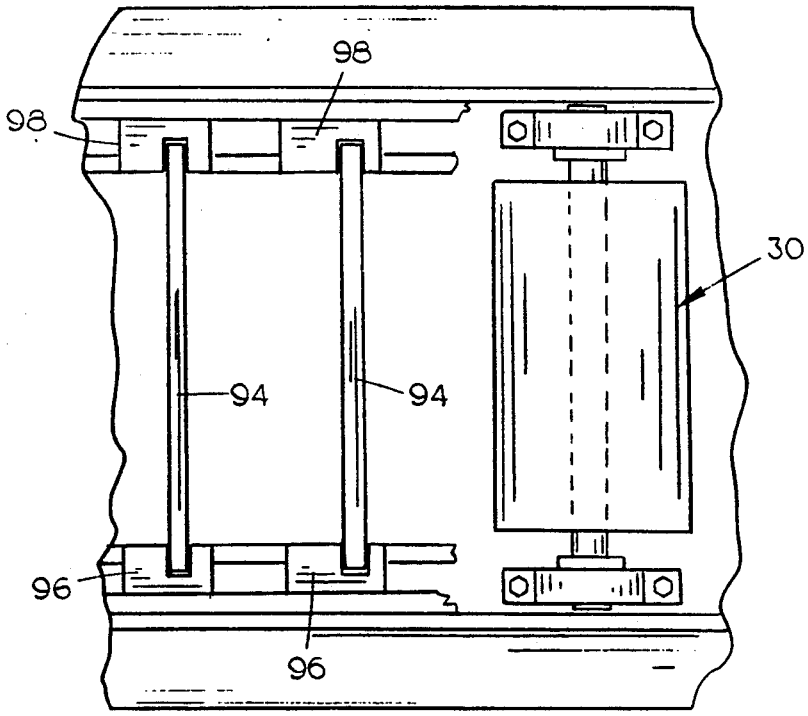
FIG. 14 is a sectional view seen on lines 14—14 of FIG. 13.

Variable position limiting gate means 34 includes an elongated horizontally disposed shaft 90 which is rotatably mounted in staging chamber 22 and which has a plurality of horizontally spaced chains 92 secured thereto which extend downwardly therefrom. A gate 94 is connected to the lower ends of each of the chains 92 and is designed to be received within opposing guides or blocks 96 and 98 as best seen in FIG. 14. Shaft 90 is rotated by means of a hydraulic motor 91 operatively connected thereto by a steel cable 93 wrapped around shaft 90 as seen in FIG. 13.

Figure 12:
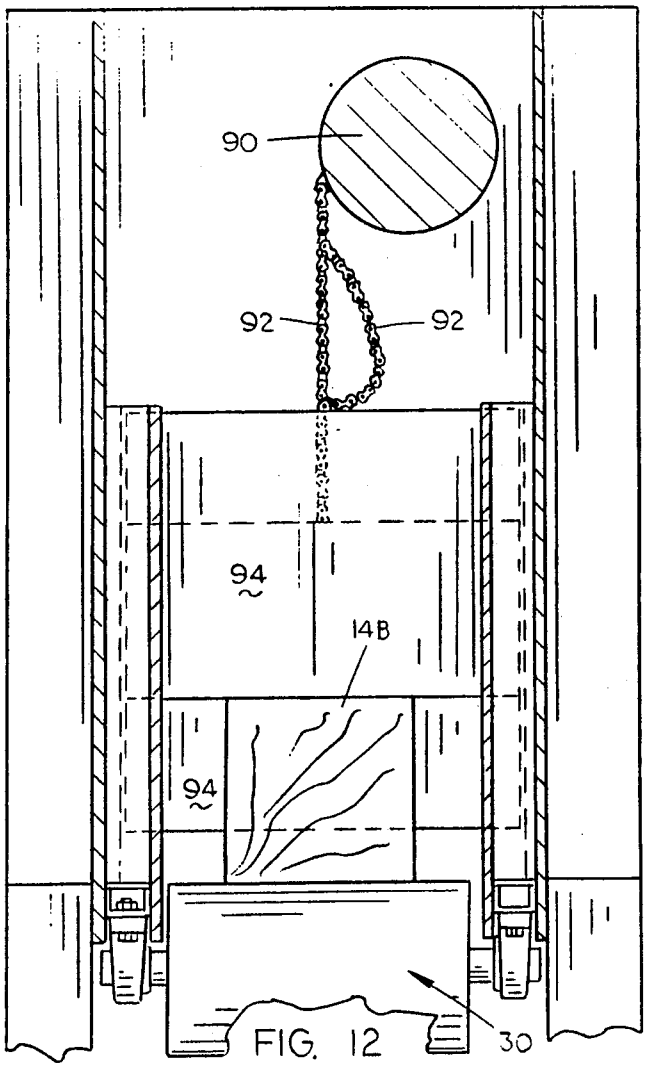
FIG. 12 is a view similar to FIG. 11 except that the variable gate has moved downwardly from the position of FIG. 11 and is resting on the switch tie.
Figure 11:
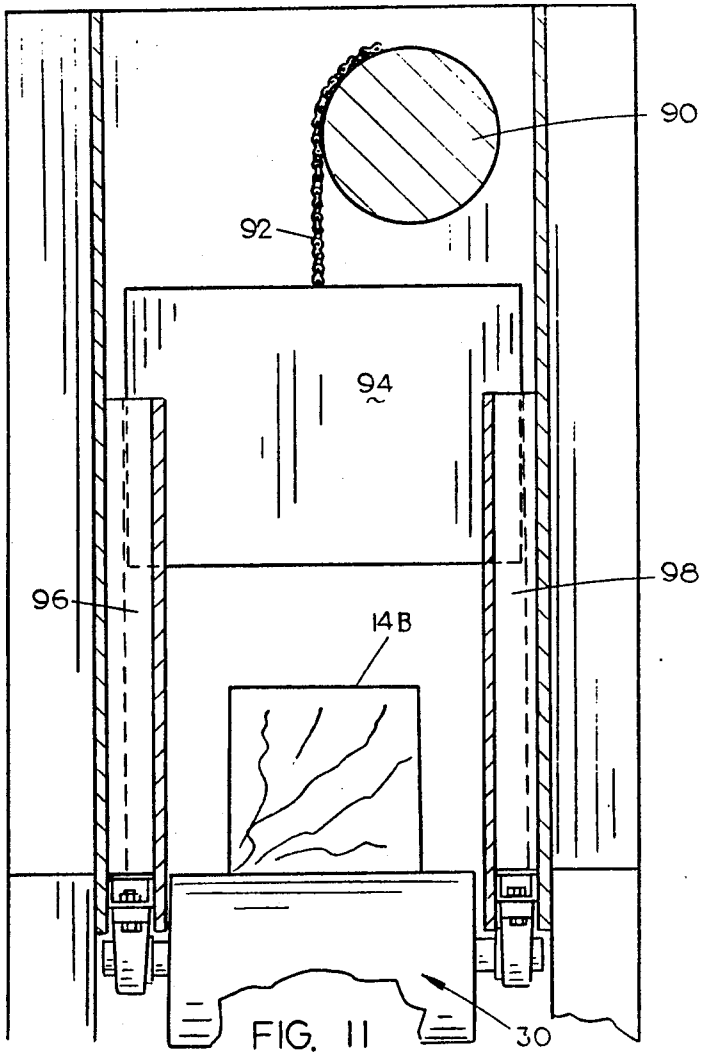
FIG. 11 is a sectional view seen on lines 11—11 of FIG. 10.

When the shaft 90 is in the position illustrated in FIG. 11, the lower ends of the gates 94 are positioned above the upper surface of the tie positioned in staging chamber 22. When the tie has been moved into staging chamber 22 and conveyor means 30 deactivated, shaft 90 is automatically rotated in a counter-clockwise direction as viewed in FIG. 12 so that the gates 94 are lowered within their respective guides 96 and 98. If a nine-foot tie is positioned in the second staging chamber, the first plate **94*a* is positioned adjacent the inner end of the tie and resists movement of the tie away from the hydraulic ram when the end plate is being forced into the end of the tie. If a nine-foot six-inch tie is in the staging chamber, the nine-foot gate 94*a* drops on the top surface of the tie and the nine-foot six-inch gate 94*b* drops all the way down as will all of the other gates positioned to the left of the tie as viewed in FIG. 1. If a 16-foot six-inch tie is in the staging chamber 22, all of the gates except the last two gates would be resting on the top surface of a tie and the 16-foot six-inch gate would have dropped down at the end of the tie clearing it so as to act as the resistance plate. Variable length ties can be run simultaneously in the staging chambers 16 and 22**.

In operation, assuming that the switch tie in staging chamber 16 already has one end thereof end plated, the conveyors 28, 40 and 30 are activated so that the switch tie is conveyed from staging chamber 16, through the end plating frame means 35, and into the staging chamber 22. Another switch tie would simultaneously be introduced into staging chamber 16. A conventional photoelectric cell sensing means S1 is provided on the frame means 64 and is operatively connected to the conveyor means 30 to deactivate the same as soon as the sensing means S1 senses the end of the switch tie as viewed in FIG. 1. Sensing means S2 is operatively connected to conveyor means 28 and will deactivate the conveyor means 28 when sensing means S2 senses the end of the tie in the staging chamber 16 as illustrated in FIG. 1. The ends of the ties to be end plated are then squeezed together as previously described. An end plate is then hand tacked onto the exposed ends of the ties.

The ram support 44 is then pivotally moved from the position illustrated in FIG. 4 to the position illustrated in FIG. 5 so that the ram means will be positioned between the ends of the cross ties in the staging chambers 16 and 22. Hydraulic cylinder 48 is then actuated to cause the rams 54 and 56 to extend therefrom to drive the end plates into the ends of the ties with the variable position gates resisting movement of the ties away from the rams.

When the end plates have been driven into the ends of the ties, ram support 44 is pivoted from the position of FIG. 5 to the FIG. 4. The variable position limiting gates are raised by the shaft 90 and the conveyors 28, 40 and 30 are then actuated to move the tie from staging chamber 16 into staging chamber 22 and to move a new tie into staging chamber 16 whereupon the process will be repeated.

Thus it can be seen that a novel end plating machine has been provided which permits the ends of two separate switch ties to be simultaneously end plated. It can also be seen that the end plating machine of this invention permits the apparatus to accommodate switch ties having various lengths and permits various length ties to be simultaneously end plated. It can therefore be seen that the invention accomplishes at least all of the stated objectives.

I claim:

1. A switch tie end plating machine capable of handling ties having various lengths, comprising, a first elongated staging chamber having an input end and a discharge end, a second elongated staging chamber longitudinally aligned with said first staging chamber and having an input end spaced from the discharge end of said first staging chamber, said second staging chamber having a discharge end spaced from its input end, an end plating frame means positioned between the discharge end of said first staging chamber and the input end of said second staging chamber, means for supplying ties to the input end of said first staging chamber, a first conveyor means in said first staging chamber for conveying a tie therethrough, a second conveyor means in said second staging chamber for conveying a tie therethrough, a third conveyor means for conveying a tie through said end plating frame means, means for compressing the ends of the ties which are to be end plated, an end plating mechanism movably mounted on said end plating frame means, said end plating mechanism including a pair of oppositely extending rams for driving end plates into the ends of ties positioned in said first and second staging chambers, means for moving said end plating mechanism between a first position wherein said rams are positioned between the ends of the ties in said staging chambers to a second position wherein said rams are not positioned between the discharge end of said first staging chamber and the input end of said second staging chamber to permit a tie to be conveyed through said end plating mechanism, tie stop means in each of said staging chambers for engaging the ends of the ties in said chambers to limit the longitudinal movement thereof when said rams seat the end plates on the ends of the ties, said tie stop means including means for automatically compensating for ties of various lengths, wherein each of said tie stop means comprises an elongated, horizontally disposed, rotatable shaft means positioned above the tie in the associated chamber means for rotating said shaft, a plurality of flexible, connector members secured to said shaft and extending downwardly therefrom, a gate means secured to the lower end of said flexible connector members, said chamber having a plurality of horizontally spaced apart guide means, each of which are adapted to receive one of said gate means when the length of the tie permits the same.

2. A tie end plating machine capable of handling ties having various lengths, comprising, a first tie staging means having an input end and a discharge end, a conveyor means associated with said first tie staging means for moving a tie therethrough, a second tie staging means having an input end and a discharge end, conveyor means associated with said second tie staging means for moving a tie therethrough, the discharge end of said first tie staging means being horizontally spaced from the input end of said second tie staging means, an end plating mechanism capable of being positioned in the space between the discharge end of said first tie staging means and the input end of said second tie staging means, said end plating mechanism including means for forcing an end plate into one end of a tie positioned in said first tie staging means and into one end of a tie positioned in said second tie staging means, and limiting means in each of said first and second tie staging means for limiting the longitudinal movement of the tie therein when said end plating mechanism is forcing an end plate into the end thereof, wherein each of said tie staging means includes an elongated chamber means having a pair of horizontally spaced and vertically disposed walls extending between the input and discharge ends, said conveyor means being positioned at the lower ends of said walls, said limiting means comprising a plurality of horizontally spaced and vertically disposed guides on opposing surfaces of each of said walls, a plurality of limiting gates vertically movably mounted in said guides, and means for raising and lowering said gates.

3. The tie end plating machine of claim 2 wherein said end plating mechanism simultaneously forces end plates into the ties positioned in said first and second tie staging means.

4. The tie end plating machine of claim 2 including means for squeezing the end of the ties prior to the end plates being forced thereinto.

5. The tie end plating machine of claim 2 wherein said means for raising and lowering said gates compresses a rotatable means positioned above said gates and operatively connected thereto.

6. The tie end plating machine of claim 5 wherein said rotatable means and said gates are connected by means of flexible members extending between said rotatable means and said gates.

* * * * *